US007730735B2

(12) United States Patent
Maruya et al.

(10) Patent No.: US 7,730,735 B2
(45) Date of Patent: Jun. 8, 2010

(54) REFRIGERANT SERVICE PORT VALVE FOR AIR CONDITIONERS

(76) Inventors: Richard H. Maruya, 44-129 Mikiola Dr., Kaneohe, HI (US) 96744; George M. Whitmyre, 24 Lochcarron Dr., Elkton, MD (US) 21921

( * ) Notice: Subject to any disclaimer, the term of this patent is extended or adjusted under 35 U.S.C. 154(b) by 400 days.

(21) Appl. No.: 11/802,429

(22) Filed: May 22, 2007

(65) Prior Publication Data

US 2008/0289353 A1 Nov. 27, 2008

(51) Int. Cl.

| | |
|---|---|
| ***F25B 45/00*** | (2006.01) |
| ***E03B 1/00*** | (2006.01) |
| ***F16K 25/00*** | (2006.01) |
| ***F16L 37/28*** | (2006.01) |

(52) U.S. Cl. ..... 62/292; 62/149; 62/77; 137/614.02; 137/614.21; 137/454.2; 251/149.1; 251/149.6

(58) Field of Classification Search ..... 62/149, 62/292, 77; 137/614.02, 614.21, 454.2; 251/149.1, 251/149.6

See application file for complete search history.

(56) References Cited

U.S. PATENT DOCUMENTS

| | | | | |
|---|---|---|---|---|
| 2,019,605 | A * | 11/1935 | Guyton | 62/206 |
| 3,266,262 | A * | 8/1966 | Moragne | 62/46.1 |
| 3,419,135 | A * | 12/1968 | Millner | 206/343 |
| 3,880,483 | A * | 4/1975 | Snyder, Jr. | 384/539 |
| 4,342,199 | A | 8/1982 | Shaw et al. | |
| 4,583,373 | A | 4/1986 | Shaw | |
| 5,333,467 | A | 8/1994 | Pearl, II et al. | |
| 5,335,511 | A | 8/1994 | McKeown | |
| 5,408,840 | A | 4/1995 | Talley | |
| 5,660,051 | A | 8/1997 | Sakakibara et al. | |
| 5,768,895 | A | 6/1998 | Albertson et al. | |
| 5,957,147 | A | 9/1999 | Hubbell, Jr. | |

(Continued)

FOREIGN PATENT DOCUMENTS

| | | |
|---|---|---|
| EP | 1 029 724 | 8/2000 |

(Continued)

OTHER PUBLICATIONS

"Expansion Valve for Car Air Conditioners" http://chumhuizk.en.alibabl.com/product/50250035/50733787/Air_Conditioner_Components/Expansion_Valve_for_Car_Air_Conditioners.html Retrieved on Mar. 12, 2007.

*Primary Examiner*—Thomas E. Denion
*Assistant Examiner*—Michael Carton
(74) *Attorney, Agent, or Firm*—Richard C. Litman

(57) ABSTRACT

The refrigerant service port valve for air conditioners has a valve body defining a main fluid conduit adapted for insertion into a coolant line using compression fittings at opposite ends of the conduit. A pedestal is mounted on the exterior conduit wall. The pedestal has a bore therethrough forming a lower service passage that enters the main fluid conduit, and an internally threaded blind bore parallel to the lower service passage. A slider is mounted on the pedestal, the slider having a male quick connect fitting defining an upper service passage. The upper service passage may be aligned with the lower service passage in an open position to service the system, or the slider may be moved to align the upper service passage with the blind bore to access a setscrew, which is raised partially into the upper service passage to lock the valve in a closed position.

19 Claims, 3 Drawing Sheets

U.S. PATENT DOCUMENTS

| | | | | |
|---|---|---|---|---|
| 6,240,738 | B1 | 6/2001 | Kato et al. | |
| 6,338,255 | B1 * | 1/2002 | Richard et al. | 62/292 |
| 7,028,496 | B2 | 4/2006 | Komatsu | |
| 7,165,421 | B2 | 1/2007 | Tsugawa | |
| 2005/0035322 | A1 * | 2/2005 | Davis et al. | 251/149.1 |
| 2005/0115270 | A1 | 6/2005 | Furuta et al. | |
| 2005/0210894 | A1 | 9/2005 | Hirota | |
| 2005/0247069 | A1 * | 11/2005 | Dudley | 62/77 |
| 2006/0027776 | A1 * | 2/2006 | Pierson | 251/149.6 |
| 2006/0086123 | A1 * | 4/2006 | Quest et al. | 62/292 |

FOREIGN PATENT DOCUMENTS

| | | |
|---|---|---|
| JP | 5-280839 | 10/1993 |
| JP | 2005-156151 | 6/2005 |

* cited by examiner

REFRIGERANT SERVICE PORT VALVE FOR AIR CONDITIONERS

BACKGROUND OF THE INVENTION

1. Field of the Invention

The present invention relates to the valves used in air conditioning systems, and more particularly to a refrigerant service port valve for air conditioners used to convert or "retrofit" legacy refrigeration systems to the use of environmentally more desirable refrigerants having different operating characteristics, in particular, the refrigerant known as HCR188C® (HCR188C is a registered trademark of A.S. Trust & Holdings Inc. of Saipan, M.P.).

2. Description of the Related Art

Chlorofluorocarbons (CFC's), such as dichlorodifluoromethane and monochlorodifluoromethane, were in heavy usage as a refrigerant for use in automotive air conditioners for many decades. The historical dominance of the CFCs had been, in part, due to their advantageous safety features such as incombustibility, high stability, and lower toxicity. However, it was discovered that the use of CFC's over the years has caused ozone layer depletion, an unquestionably negative impact on the global environment. Thus, the production and use of CFC have been gradually reduced and now tend to be abolished totally.

The automotive industry has migrated over to HFCs (hydrofluorocarbon work media) and developed automotive service port valves for the same. However, HFCs have also been implicated in global warming. Hence there has been renewed interest in alternative air conditioning refrigerants, such as hydrocarbon (HC) refrigerants, as exemplified by U.S. Pat. No. 6,336,333, issued Jan. 8, 2002 to Lindgren (commonly known as HC-12a, formerly a registered trademark of OZ Technology, Inc. of Post Falls, Id.) and U.S. Pat. No. 6,902,686, issued Jun. 7, 2005 to Richard H. Maruya, one of the present inventors, and known by the HCR188C trademark noted above.

While HC refrigerants have been approved for use in industrial process refrigeration, the U.S. EPA has not approved its use in automotive refrigerant systems, and its use as a direct replacement for CFC-12 refrigerant in automotive systems is illegal. However, its use as a replacement for HFC-134a is not restricted by the EPA. Nevertheless, the use of flammable hydrocarbon refrigerants in automotive refrigerant systems is illegal under the laws of many of the states of the United States.

In part, safety concerns have revolved around the risk of leakage into the passage compartment of vehicles in the event of a crash and possible flashback and ignition, with the resulting risk of explosion and fire. Consequently, there is a need for a service port for air conditioning refrigerant systems that incorporates safety features that reduce or minimize the risk of refrigerant leakage and that can be used to retrofit existing air conditioning systems for use of HC refrigerants.

Thus, a refrigerant service port valve for air conditioners solving the aforementioned problems is desired.

SUMMARY OF THE INVENTION

The refrigerant service port valve for air conditioners has a valve body defining a main fluid conduit adapted for insertion into a coolant line using compression fittings at opposite ends of the conduit. A pedestal is mounted on the exterior conduit wall. The pedestal has a bore therethrough forming a lower service passage that enters the main fluid conduit, and an internally threaded blind bore parallel to the lower service passage. A slider is mounted on the pedestal, the slider having a male quick connect fitting defining an upper service passage. The upper service passage may be aligned with the lower service passage in an open position to service the system, or the slider may be moved to align the upper service passage with the blind bore to access a setscrew, which is raised partially into the upper service passage to lock the valve in a closed position.

A one-way check valve and a flame arrestor may be disposed in the main fluid passage. A dust cap is disposed on the male quick connect fitting when the system is not being serviced. The dust cap and fittings may be color-coded with a color, e.g., pink, indicating approval of the refrigerant service port valve for use with hydrocarbon refrigerants by the U.S. Environmental Protection Agency if and when so approved.

In use, a first refrigerant service port valve is placed inline in the high pressure side of the air conditioning system, which may be an automotive air conditioning system, and a second refrigerant service port valve is placed inline in the low pressure side of the air conditioning system. The valves are oriented so that the flame arrestor faces the passenger compartment of the vehicle (in the outlet side of the high pressure valve or the inlet side of the low pressure side) to reduce the risk of fire in the event of an accident that severs or damages the tubing, the check valve preventing flashback or backflow of refrigerant. In normal use, refrigerant circulates in the air conditioning system through the unobstructed main fluid conduit.

When it is desired to service the system, the dust cap is removed, the setscrew is accessed through the male quick connect fitting and lowered into the blind bore, a gauge, vacuum pump, and canister are attached to the male quick connect fitting, and the slide is moved to align the upper service passage with the lower service passage, thereby opening the valve. An O-ring may seal the junction of the upper and lower passages. When servicing is complete, the slider is moved to misalign the upper and lower service passages, the service equipment is removed, the upper service passage is aligned with the blind bore, the setscrew is raised partially into the upper service passage to lock the valve in the closed position, and the dust cap is installed over the quick connect fitting.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 2:
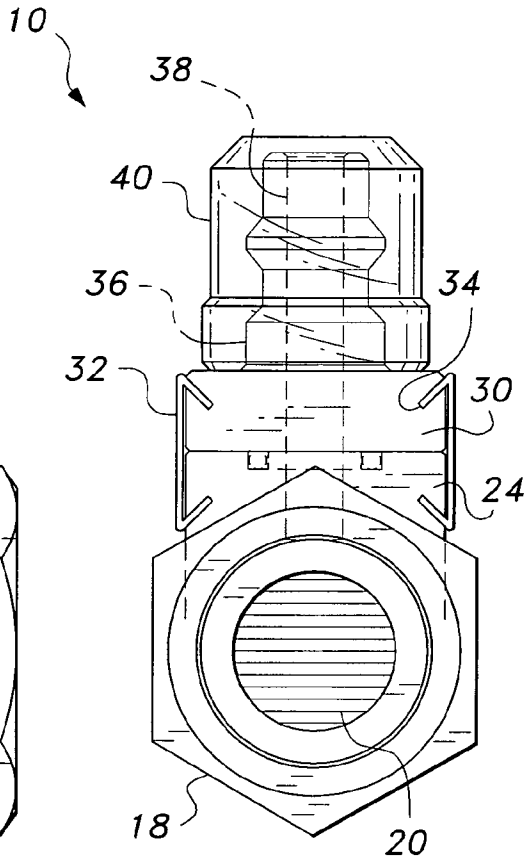
FIG. 2 is an end view of the refrigerant service port valve for air conditioners according to the present invention.

The present invention is a refrigerant service port valve, designated generally as 10 in the drawings, for use in air conditioning systems that use a hydrocarbon refrigerant, such as HCR188C. The valve 10 will be described as it might be used in an automotive air conditioning system, particularly to retrofit automotive air conditioning systems that were originally designed for HFC-134a and other legacy cooling systems. However, it will be understood that the valve 10 may be used in other air conditioning and refrigeration systems where hydrocarbon refrigerants may be used.

Figure 1A:
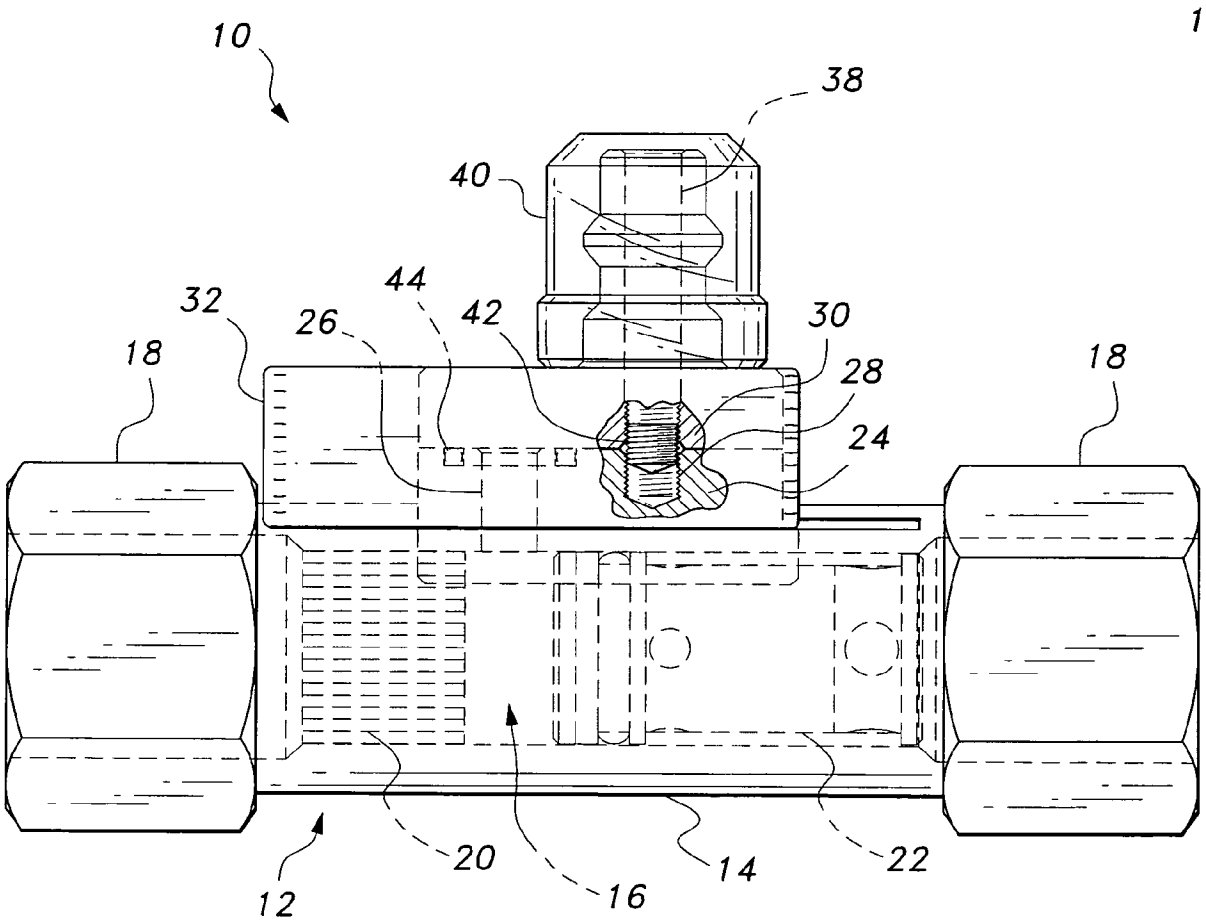
FIG. 1A is a side view of a refrigerant service port valve for air conditioners according to the present invention in the closed position, the parts broken away and partially in section to show details thereof.
Figure 1B:
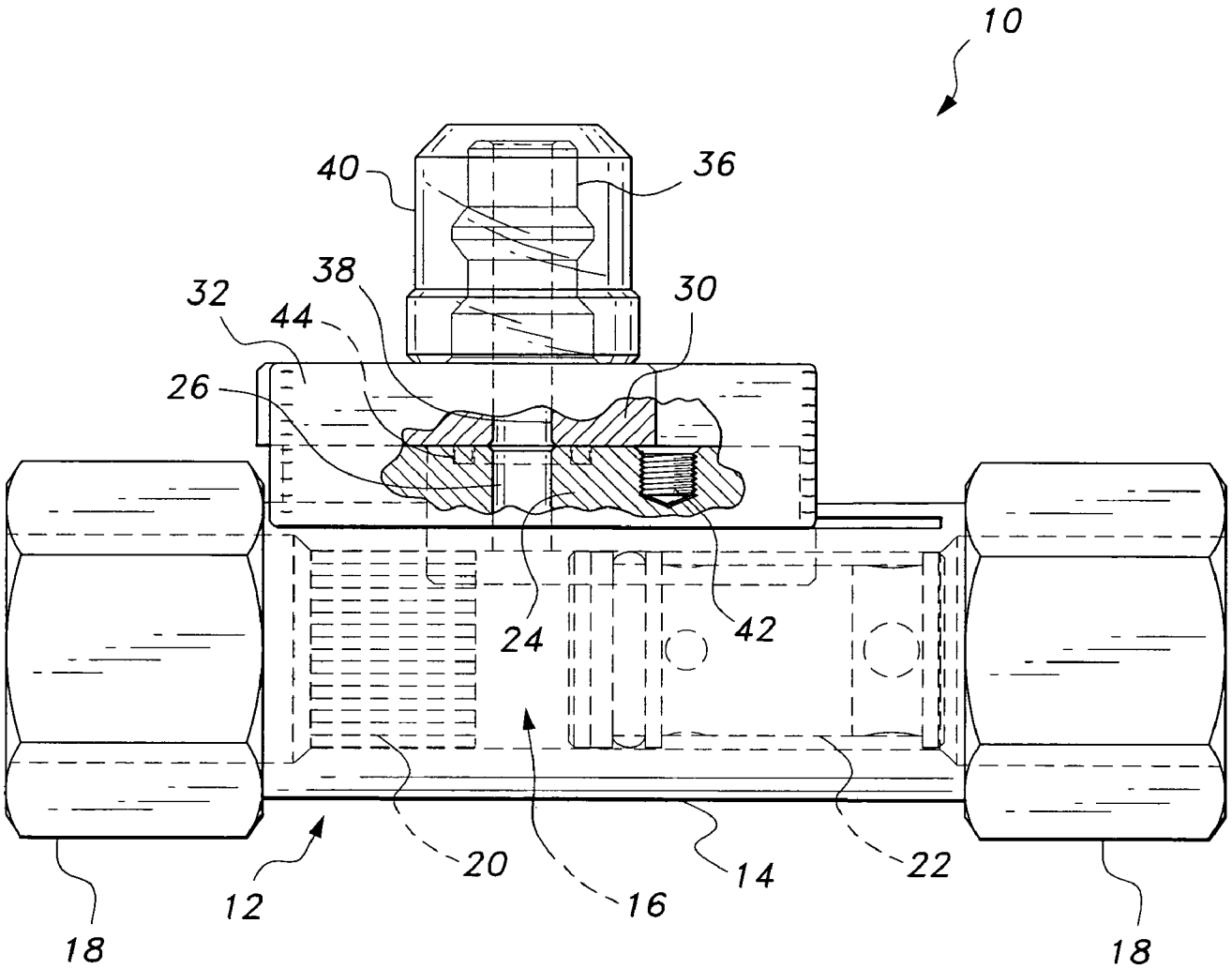
FIG. 1B is a side view of a refrigerant service port valve for air conditioners according to the present invention in the open position, the parts broken away and partially in section to show details thereof.

Referring to FIGS. 1A, 1B, and 2, the valve 10 is a three-way slider valve having a valve body 12 that includes an elongated section of pipe 14 defining a main fluid conduit 16. The pipe 14 may be equipped with compression fittings 18 at opposite ends adapted for inserting the valve 10 inline into either the high pressure or low pressure side of the cooling system. Alternatively the pipe 14 may be equipped to accommodate a brazed fitting, threaded fitting, soldered fitting, O-ring seal quick fitting, or the like. A flash or flame arrestor 20 may be disposed in the main fluid conduit 16 at one end of the valve 10. A one-way check valve cartridge 22 may be disposed in the opposite end of the valve 10. The flame arrestor 20 and the check valve 22 are safety devices primarily adapted for minimizing or reducing flashback, ignition, or backflow of the hydrocarbon refrigerant and any resultant fire or risk of explosion to the passenger compartment of an automobile in the event that the cooling lines are cut, punctured, ruptured, or otherwise damaged, e.g., in an automobile accident, although they may also provide a baffle for regulating flow of the refrigerant and permit one-way venting of the hydrocarbon refrigerant out of the evaporator coils 307 in the passenger compartment through the engine compartment refrigerant piping, if and when permitted by the EPA.

For example, with an engine turned off, an AC compressor will stop rotating, dropping the system refrigerant pressure. The check valve 22 will close in the engine off condition thus preventing additional refrigerant from flowing into the passenger compartment, thereby minimizing a leak from a damaged evaporator coil. These safety devices may not be necessary when the valve 10 is used in other systems, e.g., and industrial process air conditioning system.

The valve body 12 includes a saddle or pedestal 24 fixed or rigidly attached to the exterior of the pipe wall. The pedestal 24 has a bore 26 that extends through the pedestal 24 and the wall of the pipe 12, defining a lower service passage that opens into the main fluid conduit 16, allowing the communication of fluids between the lower service passage 26 and the main fluid conduit 16. The pedestal 24 also has an internally threaded blind bore 28 defined therein that extends parallel to the lower service passage 26.

A slider 30 is slidably mounted on the pedestal 24. In the embodiment shown, the pedestal 24 and the slider are rectangular blocks or plates, the slider 30 being retained on the pedestal 24 by elongated cleats 32. The bottom edges of the cleats 32 are rigidly attached to the pedestal 24. The pedestal 24 and the slider 30 may both be shorter in length than the cleats 32. The cleats 32 extend along the sides of the valve body 12, the cleats 32 having upper hooks or flanges 34 that either slide in channels defined in the slider 30 or over upright flanges extending along the lateral edges of the slider 30. Alternative slider mechanisms that may be used in lieu of the cleats 32 are described below.

A male quick connect fitting 36 is attached to the slider 30. The male quick connect fitting 36 is of a type approved by the EPA for use with hydrocarbon refrigerants in automotive air conditioning systems, and may be color-coded with a color, e.g., pink, to indicate such approval. (The EPA provides by regulation for color-coding such fittings, e.g., white for CFC-12, blue for HFC-134a, etc.) The fitting 36 has an axial bore 38 that defines an upper service passage. A removable dust cap 40, which may also be color-coded, or which may be transparent so that the color coding of fitting 36 is visible through the dust cap 40, is disposed over fitting 36 when the valve 10 is not being used for servicing the cooling system. The male quick connect fitting 36 is adapted for connection with a female quick connect coupler, which, in turn, may be connected to pressure gauges, vacuum pumps, hydrocarbon refrigerant canisters, and other service equipment through appropriate tubing, as conventionally known in the art.

A threaded setscrew 42 is disposed in the blind bore 28. When the upper service passage 38 is aligned with the blind bore 28, the head of the setscrew 42 may be accessed with an Allen wrench or the like. When rotated clockwise, the setscrew 42 is fully seated in the blind bore 28 with no part of the setscrew 42 raised above the upper surface of the pedestal 24, thereby permitting free lateral movement of the slider 30. This allows the slider 30 to be moved to place the valve 10 in the open position, as shown in FIG. 1B. In the open position, the upper service passage 38 is aligned with the lower service passage 26, the two aligned passages forming the service port. An O-ring 44 may be seated on the pedestal 24 about the mouth of the lower service passage 26 to provide a seal with the male quick connect fitting 36. When rotated counterclockwise, the head of the setscrew 42 is raised into the upper service passage bore 38, preventing lateral movement of the slider 30, as shown in FIG. 1A. The upper service passage bore 38 may be provided with a shoulder to limit upward travel of the setscrew 42, if desired.

The valve body 12 and quick connect fitting 36 can be made from a polymer, a filled polymer, ceramics, composites, metal, or combinations thereof. Metal is preferred, and aluminum, zinc, steel, magnesium, bronze or even brass alloys, which are cast, molded, or fused from powdered metal, machined from castings or bar stock, or produced by a plurality of these or other well-known machining and forming methods. The exterior valve body 12, slider 30, and other components can be spray-painted or powder coated with the EPA identification color code, e.g., pink.

Connections to the refrigeration or cooling system tubing may be made with compression fittings 18, which may include instant tube fitting ends, compression tube fitting ends, butt-welded fitting ends, friction-stir weld ends, spline-sleeve union, setscrew collar, or other tube-joining devices/methods.

The dust cap 40 is preferably tight fitting, and in combination with the setscrew 42 within the quick connect fitting 36, discourages tampering by untrained personnel. An added security feature of the setscrew 42 is that it may be right hand threaded and may have a finished top shoulder, similar to a die stripper screw. The screw 42 can lock with counterclockwise (CCW) turns into the quick connect fitting 42. The setscrew 42 may have an Allen-type head, and may engage an Allen wrench, or may be a security screw that uses a spline, Torx, center security pin, or other irregular-broached keyway.

The slider 30 may be retained on pedestal 24 by any suitable slide mechanism, including dovetail guides, channels, flat-head guide screws, or other suitable slider mechanism. It will be understood that the slider 30 need not be a rectilinear slider. For example, the pedestal 24 and the slider 30 may be circular, with the slider 30 being joined to the pedestal 24 by a spindle that allows the slider to rotate in an arc across the face of the pedestal 24 to align the male quick connect fitting 36 with the lower service passage 26 or the blind bore 28 to open or close the valve 10. The pedestal 24 and the slider 30 may be provided with suitable stops that restrict the arc in which the slider 30 may rotate.

The check valve cartridge 22 can prevent backflow of HCR (hydrocarbon refrigerant) and can allow safe, one-way venting of hydrocarbon refrigerant out of an evaporator coil in a passenger compartment of a vehicle by means of the engine compartment refrigerant piping. Spring tension in the check valve 22 may be selected to work in conjunction with an existing low-pressure cutoff switch, typically found in automotive air conditioning systems.

The flash or flame arrestor 20 may be a parallel plate, a spiral plate, a sintered plate, a stacked screen flame arrestor, or any other device that can act as a flame arrestor heat sink to prevent flame travel into the passenger compartment through the refrigeration tubing. When properly sized the flame arrestor 20 can also provide a flow orifice or baffle to moderate the refrigerant flow in normal operation.

In addition to, or instead of, setscrew 42, a horizontal locking security setscrew perpendicular to the quick connect fitting 36 may be employed to lock the cleat 32, dovetail, channel or other sliding mechanism. The security setscrew can have left-hand threads to provide yet another element of anti-tamper protection.

Instead of O-ring 44, alternative devices to seal the sliding valve elements may include, but are not limited to, a poured, powder coated, sprayed, or pressure coated elastomer or polymer seal, flat gasket, rolling gasket or temporary or permanent liquid-hardening sealant, and may even include an O-ring seal of various compositions, including composite materials.

In use, a first refrigerant service port valve 10*a* is placed inline in the high pressure side of the air conditioning system, which may be an automotive air conditioning system, and a second refrigerant service port valve 10*b* is placed inline in the low pressure side of the air conditioning system. The flame arrestor 20 reduces the risk of fire in the event of an accident that severs or damages the tubing. The check valve 22 also prevents flashback, ignition, or backflow of refrigerant. In normal use, refrigerant circulates in the air conditioning system through the unobstructed main fluid conduit 16.

When it is desired to service the system, the dust cap 40 is removed, the setscrew 42 is accessed through the male quick connect fitting 36 and lowered into the blind bore 28, a gauge, vacuum pump, and canister are attached to the male quick connect fitting 36, and the slider 30 is moved to align the upper service passage 38 with the lower service passage 26, thereby opening the valve 10*a* or 10*b*. An O-ring 44 may seal the junction of the upper 38 and lower 26 passages. When servicing is complete, the slider 30 is moved to misalign the upper and lower service passages 38 and 26, the service equipment is removed, the upper service passage 38 is aligned with the blind bore 28, the setscrew 42 is raised partially into the upper service passage 38 to lock the valve 10*a* or 10*b* in the closed position, and the dust cap 40 is installed over the quick connect fitting 36.

Figure 3:
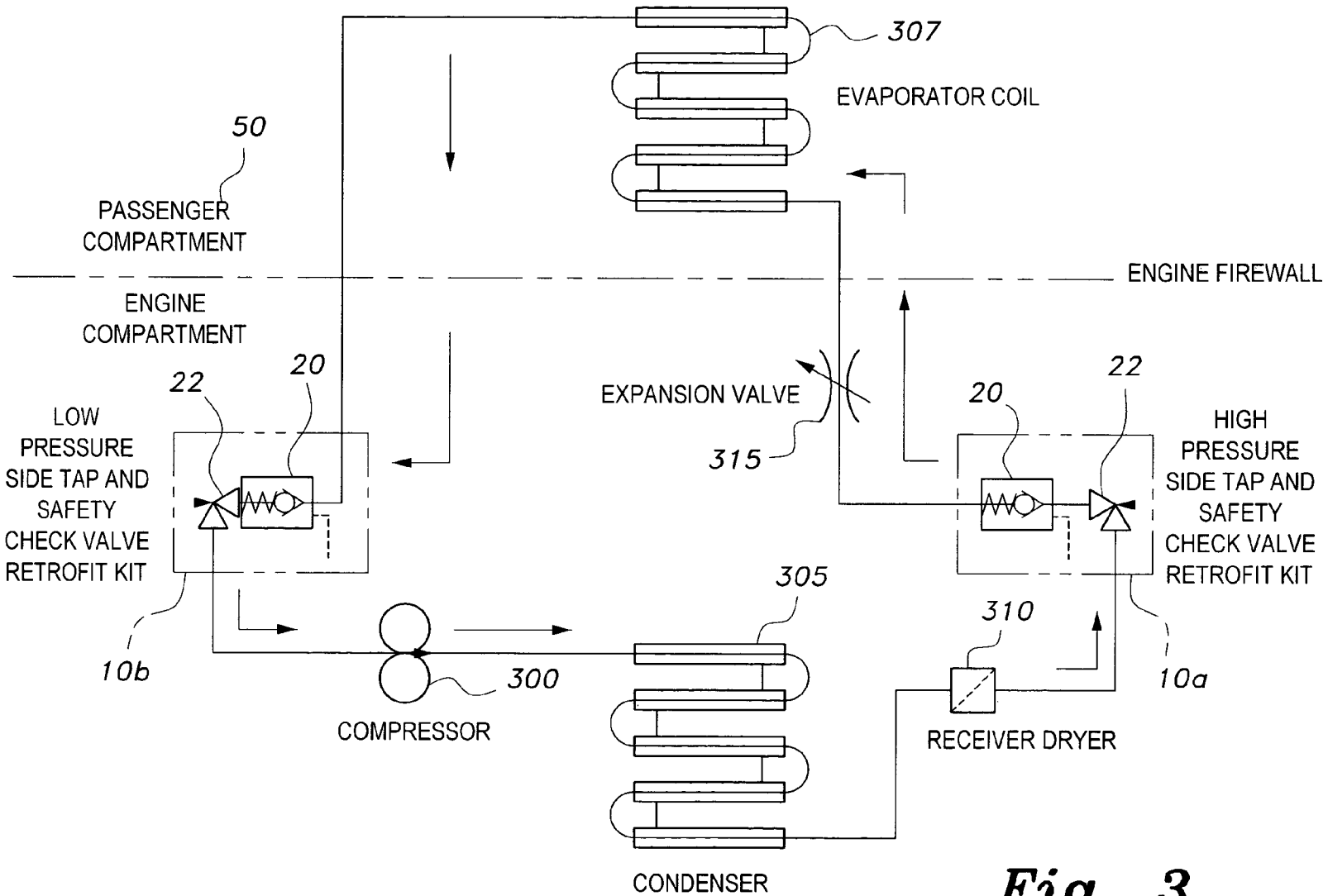
FIG. 3 is a schematic diagram showing low side and high side insertion points in an expansion valve air conditioning system adapted for the refrigerant service port valve for air conditioners according to the present invention.

As shown in FIG. 3, refrigerant service port valve 10 can be connected to low pressure and/or high-pressure plumbing of the air conditioner system. Preferably, on the high-pressure side, the refrigerant service port valve 10*a* is connected to a line that is between the receiver dryer 310 and the expansion valve 315. Preferably, on the low-pressure side, the refrigerant service port valve 10*b* is connected to a line that is between the evaporator coil 307 and the compressor 300. Plumbing lines between the compressor 300, condenser 305 and receiver dryer 310 are preferably left intact, with no service port modifications.

In preparation for installation of the service port valves 10*a* and 10*b*, a pre-existing fluorohydrocarbon (FHC) refrigerant may be removed for disposal with a standard refrigerant vacuum pump and collected in an evacuated 20-pound refrigerant canister. The evacuated refrigeration system can be prepared for installation of service port valves 10*a* and 10*b* by cutting out the legacy low pressure and high pressure charging ports with a tubing cutter or similar device and then deburring the tubing ends.

Any metal chips discovered when inspecting the prepared tubing ends are carefully removed, and rubber stoppers may be inserted temporarily during paint removal. The paint or powder coating can be removed from ¾ of each cut tube end down to bare metal with emery cloth.

The valves 10*a* and 10*b* can then be slipped onto the cut and prepared low pressure tubing ends. The quick connect fittings 36 are preferably oriented vertically upwards, and the fitting compression nuts 18 should be properly tightened using two opposing wrenches.

To charge the system with the hydrocarbon refrigerant, both valves 10*a* and 10*b* are unlocked by inserting a splined Allen key through the quick connect fitting bore 38 to engage the splined security setscrew 42, turning clockwise until the screw bottoms. The slider valves 10*a* and 10*b* are opened by sliding the slider 30 horizontally over the pedestal 24. The cleats 32 may have stops to stop the slider 30 when the upper service passage 38 is aligned with the lower service passage 26.

A standard refrigeration gauge set equipped with a female quick connect coupler can be connected to the respective high and low pressure male quick connect fittings 36 of valves 10*a* and 10*b*. The gauge set hoses are connected to the vacuum pump and to the HCR188C refrigerant dip tube canister, and the valves 10*a* and 10*b* are set for system evacuation. This process is a standard refrigerant charging practice well known to those of ordinary skill in the art, as performed by certified HVAC technicians.

The vacuum pump may be operated until the system is evacuated to remove all air and moisture within the system, at which time the vacuum port valve is closed and the pump is stopped.

With the hose valves set to isolate the evacuated charge gauge tube, the connected valve 10*a* or 10*b* is opened, and the gauge tube needle valve is opened to meter the HCR flow. The canister valve is shut off, followed by closing the gauge tube needle valve when the correct charge volume is shown by an HCR liquid meniscus at the correct volume reading.

Next, the gauge hose low-pressure charge valve is opened to admit the metered HCR into the refrigeration system. The gauge set may remain connected to the high-pressure 10*a* and low-pressure 10*b* HCR ports, while the refrigeration compressor is run to verify that the system pressures are within parameters, indicating the correct charge volume. Following this test, or following the system charge of the HCR contents from the charge gauge tube into the low pressure valve 10*b* without testing, the valve 10*b* is closed, the quick connect fitting 36 is disconnected, and the setscrew 42 is retracted into the quick connect fitting 36 by turning setscrew 42 counterclockwise. The identical procedure is followed for the closing and securing the high pressure HCR valve 10*a*.

It is to be understood that the present invention is not limited to the embodiment described above, but encompasses any and all embodiments within the scope of the following claims.

We claim:

1. A refrigerant service port valve, comprising:

an elongated pipe adapted for inline insertion into a refrigerant system, the pipe defining a main fluid conduit, the pipe having an exterior;

a pedestal rigidly attached to the exterior of the pipe, the pedestal and the pipe having a bore extending therethrough defining a lower service passage communicating with the main service passage, the pedestal further having an internally threaded blind bore defined therein extending parallel to the lower service passage;

a slider slidably mounted on the pedestal;

a service port fitting mounted on the slider, the fitting having an axial bore extending therethrough defining an upper service passage, the slider being movable between a closed position in which the upper service passage is aligned with the blind bore while the slider closes the lower service passage, and an open position in which the upper service passage is aligned with the lower service passage to define a refrigerant service port and means for providing a fluid-tight seal between said service port fitting and said pedestal when said slider is in the open position; and a setscrew disposed in the blind bore, the setscrew being accessible through the refrigeration service port and movable between a position in which the set screw is entirely disposed in the blind bore to permit sliding the slider to the open position, and a position in which a portion of the setscrew is raised into the upper service passage to lock the slider in the closed position.

2. The refrigerant service port valve according to claim 1, further comprising a flame arrester disposed in said main fluid conduit to prevent flashback and ignition of refrigerant in the system.

3. The refrigerant service port valve according to claim 1, further comprising a check valve cartridge disposed in said main fluid conduit to insure unidirectional flow of refrigerant in the system.

4. The refrigerant service port valve according to claim 1, further comprising:

a flame arrester disposed in said main fluid conduit to prevent flashback and ignition of refrigerant in the system; and a check valve cartridge disposed in said main fluid conduit to insure unidirectional flow of refrigerant in the system.

5. The refrigerant service port valve according to claim 1, wherein said refrigerant service fitting comprises a male quick connect fitting.

6. The refrigerant service port valve according to claim 5, further comprising a dust cap removably disposed over said male quick connect fitting.

7. The refrigerant service port valve according to claim 1, wherein said setscrew comprises a security screw.

8. The refrigerant service port valve according to claim 1, further comprising means for providing visual indication restricting application of the valve to systems utilizing a hydrocarbon refrigerant.

9. The refrigerant service port valve according to claim 1, further comprising an O-ring disposed on said pedestal about said lower service passage, the O-ring providing a fluid-tight seal between said upper service passage and said lower service passage when said slider is in the open position.

10. The refrigerant service port valve according to claim 1, further comprising a fitting disposed on opposite ends of said pipe adapted for retrofitting said pipe into a legacy automotive air conditioning system in order to permit the legacy system to use a hydrocarbon refrigerant.

11. A refrigerant service port valve, comprising:

an elongated pipe adapted for inline insertion into a refrigerant system, the pipe defining a main fluid conduit, the pipe having an exterior;

a flame arrester disposed in the main fluid conduit to prevent flashback and ignition of refrigerant in the system;

a check valve cartridge disposed in said main fluid conduit to insure unidirectional flow of refrigerant in the system;

a pedestal rigidly attached to the exterior of the pipe, the pedestal and the pipe having a bore extending therethrough defining a lower service passage communicating with the main service passage;

a slider slidably mounted on the pedestal;

a service port fitting mounted on the slider, the fitting having an axial bore extending therethrough defining an upper service passage, the slider being movable between a closed position in which the slider closes the lower service passage, and an open position in which the upper service passage is aligned with the lower service passage to define a refrigeration service port and means for providing a fluid-tight seal between said service port fitting and said pedestal when said slider is in the open position; and means for locking the slider in the closed position.

12. The refrigerant service port valve according to claim 11, wherein said refrigerant service fitting comprises a male quick connect fitting.

13. The refrigerant service port valve according to claim 11, further comprising means for providing visual indication restricting application of the valve to systems utilizing a hydrocarbon refrigerant.

14. The refrigerant service port valve according to claim 11, wherein said means for locking the slider in the closed position comprises:

an internally threaded blind bore defined in said pedestal extending parallel to the lower service passage, said upper service passage being aligned with the blind bore in the closed position; and a setscrew disposed in the blind bore, the setscrew being accessible through the refrigeration service port and movable between a position in which the set screw is entirely disposed in the blind bore to permit sliding the slider to the open position, and a position in which a portion of the setscrew is raised into the upper service passage to lock the slider in the closed position.

15. A refrigerant service port valve, comprising:

an elongated pipe adapted for inline insertion into a refrigerant system, the pipe defining a main fluid conduit, the pipe having an exterior;

a pedestal rigidly attached to the exterior of the pipe, the pedestal and the pipe having a bore extending therethrough defining a lower service passage communicating with the main service passage, the pedestal further having an internally threaded blind bore defined therein extending parallel to the lower service passage;

a slider slidably mounted on the pedestal;

a male quick connect fitting mounted on the slider, the fitting having an axial bore extending therethrough defining an upper service passage, the slider being movable between a closed position in which the upper service passage is aligned with the blind bore while the slider closes the lower service passage, and an open position in which the upper service passage is aligned with the lower service passage to define a refrigeration service port and means for providing a fluid-tight seal between said service port fitting and said pedestal when said slider is in the open position; and a setscrew disposed in the blind bore, the setscrew being accessible through the refrigeration service port and movable between a position in which the set screw is entirely disposed in the blind bore to permit sliding the slider to the open position, and a position in which a portion of the setscrew is raised into the upper service passage to lock the slider in the closed position.

16. The refrigerant service port valve according to claim 15, further comprising means for preventing flashback and ignition of refrigerant from said pipe to the system.

17. The refrigerant service port valve according to claim 16, wherein said means for preventing flashback and ignition comprises a flame arrestor disposed in said main fluid conduit.

18. The refrigerant service port valve according to claim 17, wherein said means for preventing flashback and ignition further comprises a check valve cartridge disposed in said main fluid conduit.

19. The refrigerant service port valve according to claim 15, further comprising means for restricting flow of refrigerant through said main fluid conduit to a uni-directional flow.

* * * * *